US005490396A

United States Patent [19]

Morris

[11] Patent Number: 5,490,396

[45] Date of Patent: Feb. 13, 1996

[54] PORTABLE COOLING CONTAINER

[76] Inventor: Richard Morris, P.O. Box 821003, South Florida, Fla. 33082

[21] Appl. No.: 116,803

[22] Filed: Sep. 7, 1993

[51] Int. Cl.[6] ..... F25D 3/08

[52] U.S. Cl. ..... 62/457.2; 62/530; 62/371

[58] Field of Search ..... 62/457.1, 457.2, 62/457.4, 457.5, 457.7, 371, 529, 530; 220/DIG. 10, 426, 404

[56] References Cited

U.S. PATENT DOCUMENTS

| | | | |
|---|---|---|---|
| 1,696,138 | 12/1928 | Day et al. | 62/530 |
| 2,496,296 | 2/1950 | Lobl | 62/31 |
| 2,619,801 | 12/1952 | Evans | 62/371 |
| 2,989,856 | 6/1961 | Telkes | 62/371 |
| 3,187,518 | 6/1965 | Balr et al. | 62/530 |
| 3,262,283 | 7/1966 | Taylor | 62/530 |
| 4,211,091 | 7/1980 | Campbell | 62/372 |
| 4,324,111 | 4/1982 | Edwards | 62/457.1 |
| 4,343,158 | 8/1982 | Campbell | 62/372 |
| 4,509,645 | 4/1985 | Hotta | 206/345 |
| 4,537,313 | 8/1985 | Workman | 206/545 |
| 4,892,226 | 1/1990 | Abtahi | 220/412 |
| 5,005,374 | 4/1991 | Spitler | 62/259.3 |

*Primary Examiner*—Henry A. Bennet
*Assistant Examiner*—William C. Doerrler

[57] ABSTRACT

A portable container which may be refrigerated is provided which is composed of a flexible floor, walls, and lid and composed of inner and outer walls with flexible refrigerant gel captivated between these walls, floor and lid. The lid may be closed to the container with a device selected from the group consisting of nylon zippers and velcro seals. The entire container may be compressed or folded in a relatively flat position in order to be easily placed into the freezer so that the gel can be frozen for cooling purposes.

11 Claims, 8 Drawing Sheets

PORTABLE COOLING CONTAINER

BACKGROUND OF THE INVENTION

FIELD OF THE INVENTION

This invention relates to a container and more particularly to a container which is adapted to be placed in a freezer so that the liquid gel comprising the walls, floor and lid can be cooled so that, subsequently, material in the container may be maintained in a chilled condition.

SUMMARY OF THE INVENTION

There has long been a need for a container in which materials can be placed which are chilled and will remain chilled for a longer period of time outside of a refrigerator. For example, a perishable sandwich and beverage would be placed into the container, chilled and thereafter, maintained in the chilled condition for use, for example at school, work or at a picnic.

In the past there have been numerous types of containers for maintaining items in a cooled condition. For example U.S. Pat. No. 3,187,518 is a Thermal Chest container which is portable and of a foam polystyrene material surrounding the container. Within the chest compartment area is placed a self-contained refrigerant tray or shelf, designed to keep perishables cool when placed on top of the shelf or in the compartment below the shelf. The refrigerant tray is removed from the chest, placed in a deep freeze and when frozen placed back into the thermal chest. U.S. Pat. No. 2,496,296 illustrates a portable refrigerated container, in which various sections of a wall may be individually removed, refrigerated and replaced. The refrigerated walls of this reference are in effect lined with refrigerant in separate packages.

It is the object of this invention to provide a refrigerant container. It has double walls, floor and lid which are filled with a refrigerant to form a refrigerant pack or packs. It has a lid that closes to the container with a nylon zipper or a velcro closure means. This sufficiently seals the entire lid to the container upper wall parimeter so that the materials in the container remain chilled for an extended period of time. The entire container walls, floor and lid are made of a flexible material. The refrigerant contained in the hollow walls, lid and floor is also flexible, therefore permitting the container to be folded and more easily placed into the freezer in order to freeze the refrigerant. This refrigerant container as a singular unit does not require assembly or dis-assembly, therefor saving time when utilized.

BRIEF DESCRIPTION OF THE DRAWINGS

In accordance with this general invention, the disclosure follows herein wherein reference is made to the accompanying drawings in which.

DESCRIPTION OF THE PREFERRED EMBODIMENTS

Figure 1:
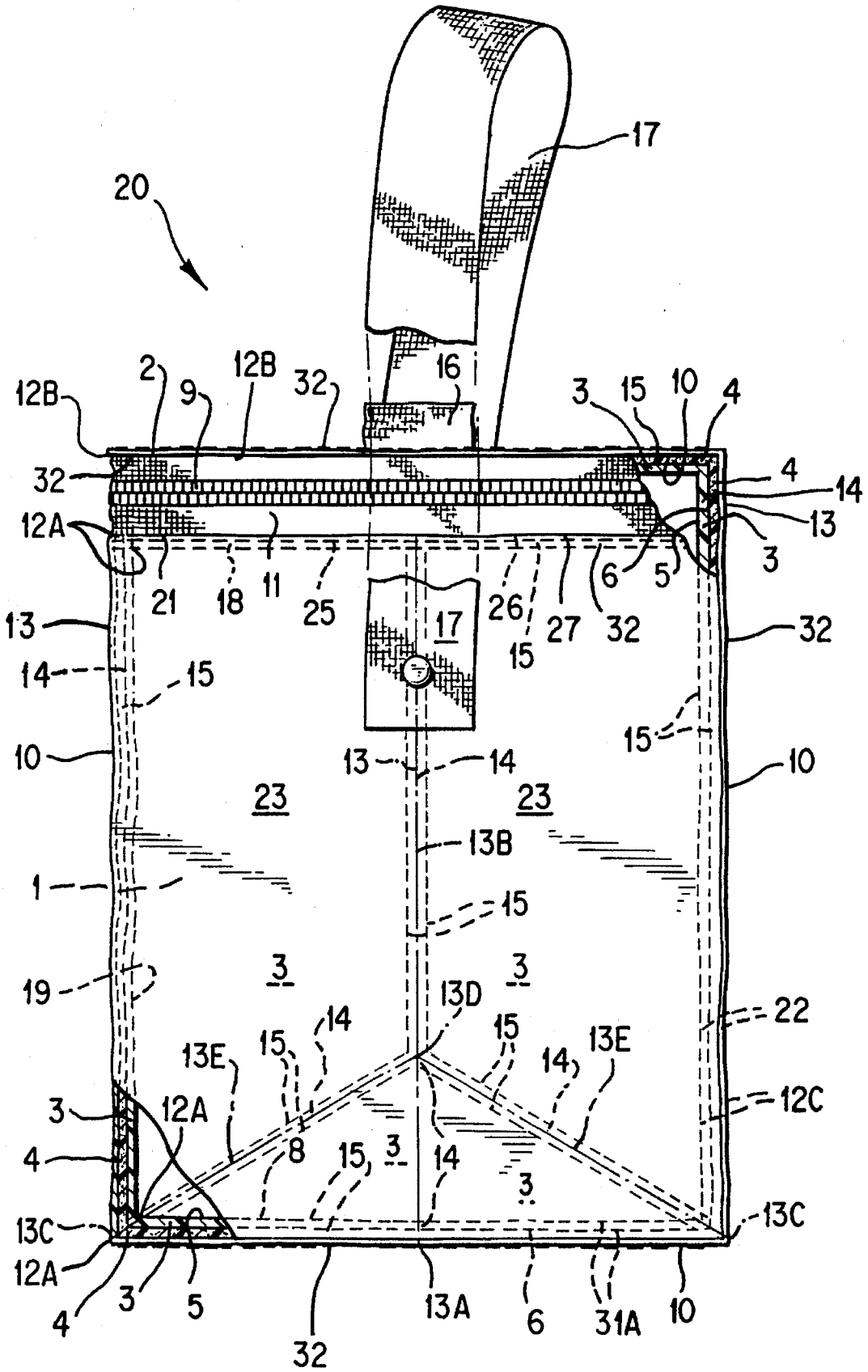
FIG. 1 is a side view in cross-section of a container in a rectangular embodiment.

The container generally designated in FIG. 1 of the drawing by numeral 20 is composed of a cooler, the purpose of which is to preserve perishables. The container includes a lid 2. The container lid may be embodied in a plurity of shapes.

The material of the container's interior and exterior walls or skins 8 and 10 are made of, but not limited to, material such as vinyl or nylon. The container includes a floor, walls and lid. The interior and exterior walls 8 and 10 respectively, floor and lid are composed of, but not limited to, a flexible material such as vinyl or nylon which defines the floor, walls and lid. There is defined a cavity 22 between the inner and outer skins. The upper, lower and back ends of inner and outer skins, 8 and 10, define an opening following the top and bottom terminal perimeter of the walls front and sides 12A, the terminal ends of the lid front and sides 12B and back wall terminal sides perimeter 12C; and through these openings refrigerated gel packs 3, foam insulation 4 and condensation shields 5,6 may be introduced into the cavity 22 between inner and outer walls and attached to seams 32 at wall floor and lid terminal ends with a sealing means in order to hold in place the inner and outer skins, gel packs, foam insulation and condensation shields.

A sealing means which may be a zipper means or a hook and loop type fastener means 9, known in the field as a Velcro type fastener, which seals the lid 2 to the peripheral zone of the upper front and sides of the wall perimeter, 21. In addition the fabric 11 which is attached to the sealing means may be sewn at the upper walls and lid terminal parimeters 12A, 12B.

Whatever the container shape, so long as practical, the container is comprised of exterior 10 walls, floor and lid skin that follow the design of the interior 8 walls, floor and lid of container 20 skin so that the area between the interior and exterior skins is hollow 22. This cavity is filled with a plurity of inter-connected flexible gel packs 3 and these surround the entire area within the wall, floor and lid chambers. The gel packs may be of flexible, inter-connected gel packs. See FIG. 1. 3 and FIG. 8, that conform to the design of the container walls, floor and lid FIG. 1. 15, FIG. 8. 15.

The gel is to be frozen when the container is placed into the freezer and thereafter when in use, the contents of the container will remain chilled. It will be apparent that the refrigerating gel never touches the contents of the container and that the gel is completely sealed within the hollow walls.

Figure 8:
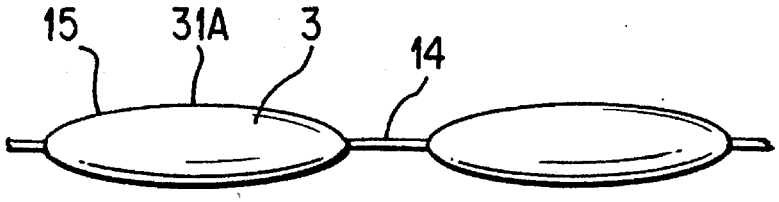
FIG. 8 is a side view flat position of two gel pack encasements with refrigerant gel inside and both encasements connected by an inter-connecting, flexible plastic strip.

The gel itself 3 FIG. 8. may be completely sealed within it's own flexible plastic non-porous packet 31A. These gel packs may be interconnected by flexible, non-porous, thin plastic hinge-like, strips, see FIG. 8 said packs 14 and 15 connected to each other, permitting the gel packs to fold and conform to the creases, see FIG. 1. at 13A thru 13E which are designed to conform to the folding of the container walls. Therefor the combination of flexible double-walled skins 8 and 10 FIG. 1, with flexible inter-connecting gel packs 3 and 14 interiorly that conform to the double hollow walls which have creases 13, all designed to conform to the folding of the walls, floor and lid in unison, permitting the container to be folded into a relatively flat position for freezer placement and freezing.

Flexible condensation shields 5,6 may be introduced, lie next to and conform to the design of the entire area of the gel pack wall exteriors 31A in order to keep any potential gel condensation from reaching the interior walls 8 and the insulating foam 4.

Insulating foam 4 may be introduced between the exterior condensation shield 6 and the exterior walls 10 which is flexible and yields to conform to the folding of the walls, floor and lid.

In FIG. 1, the creases 13A along the middle of the floor bottom horizontally from side end to side end, along the middle of both side walls vertically 13B top to near bottom and from all side bottom corners 13C heading diagonally at approximately a 45 degree angle while the container is in a non-compressed position; creases toward vertical crease in the middle of both sides 13B approximately one third the way up from the floor 13D. 45 degree diagonal creases 13C meeting the middle side vertical creases 13B forms a triangle along the floor wall 10 from front to back to triangular pinnacle 13D approximately one third the way up vertically at the middle of the side creases 13B.

All creases parallel all flexible inter-connecting plastic attaching strips 14 that connect the plurality of gel packs together contained in the walls, floor and lid so that all gel packs 15 will fold when the container walls from front to back are compressed together toward a relatively flat position. When compression takes place, side, bottom and diagonal creases 13 along with the floor and walls move inward 13 toward the interior of the content containment area 1 together with the corresponding inter-connecting plastc strips 14. Compression of the container allows the front and back walls to come together so that container can conveniently be placed into the freezer in a relatively flat position. The purpose of the container adjusting to this flat position is to conserve freezer space.

The top exterior of the lid 2 may have a handle 16 for carrying and a strap 17 attached to the exterior walls 10.

Figure 2:
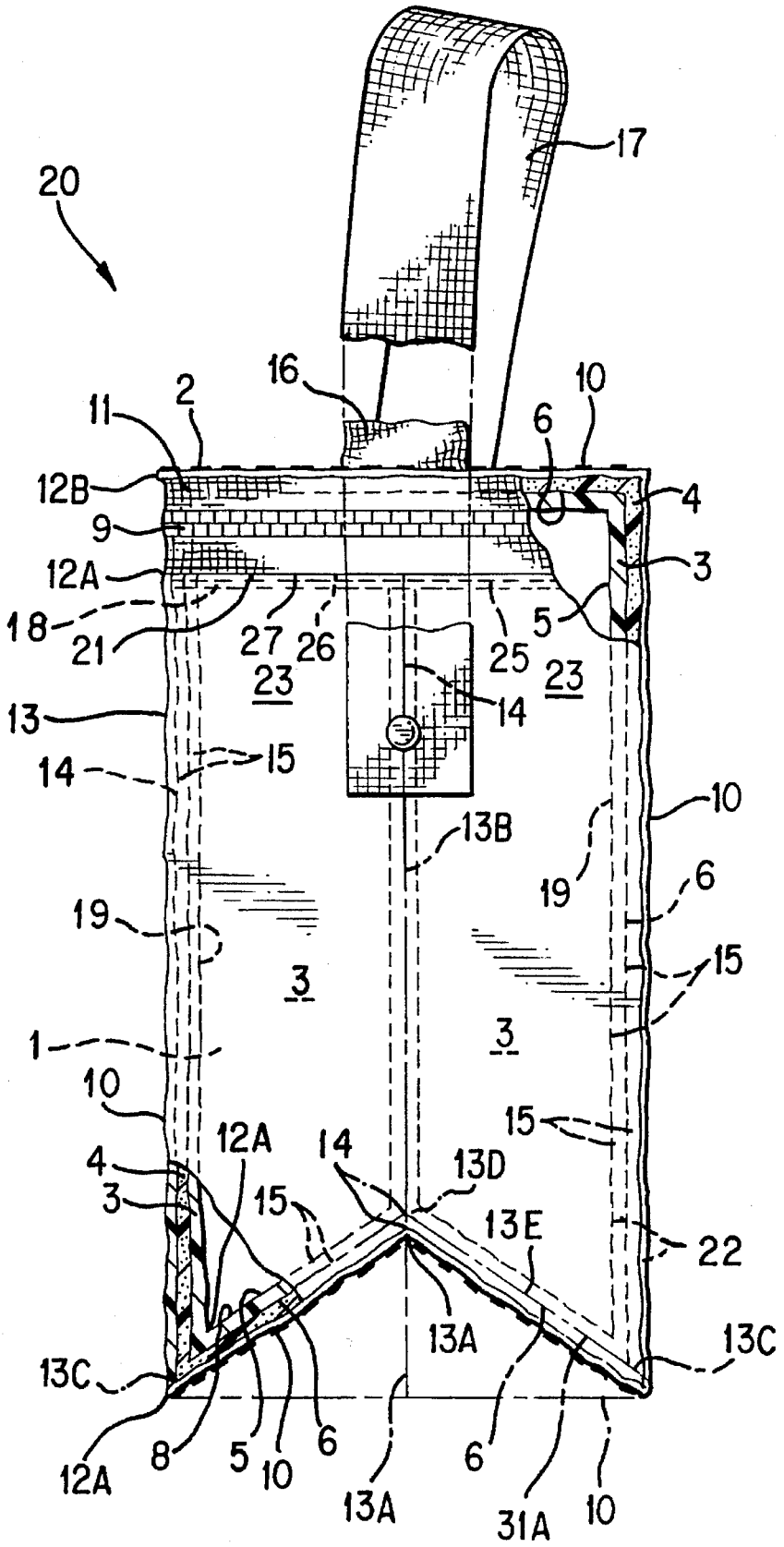
FIG. 2 is a side view of the container in cross-section while in a partially folded or compressed position.

The embodiment of FIG. 2 shows portable cooling container in a partially compressed position. Side walls 23 are folding inward and floor 10 is folding upward. Walls and floor fold along all creases 13A thru 13E with gel packs 3 and their inter-connecting flexible plastic strips 14. Even a singular gel pack which may be utilized, that is placed throughout the hollow walls, floor and lid without the use of connecting flexible plastic strips folds, with relative ease, especially in an unfrozen condition.

In FIG. 2, as the walls, floor and gel are compressed inward, so to is the insulating foam 4, condensation shields 5,6, interior 8 and exterior skins 10 of walls and floor.

Figure 3:
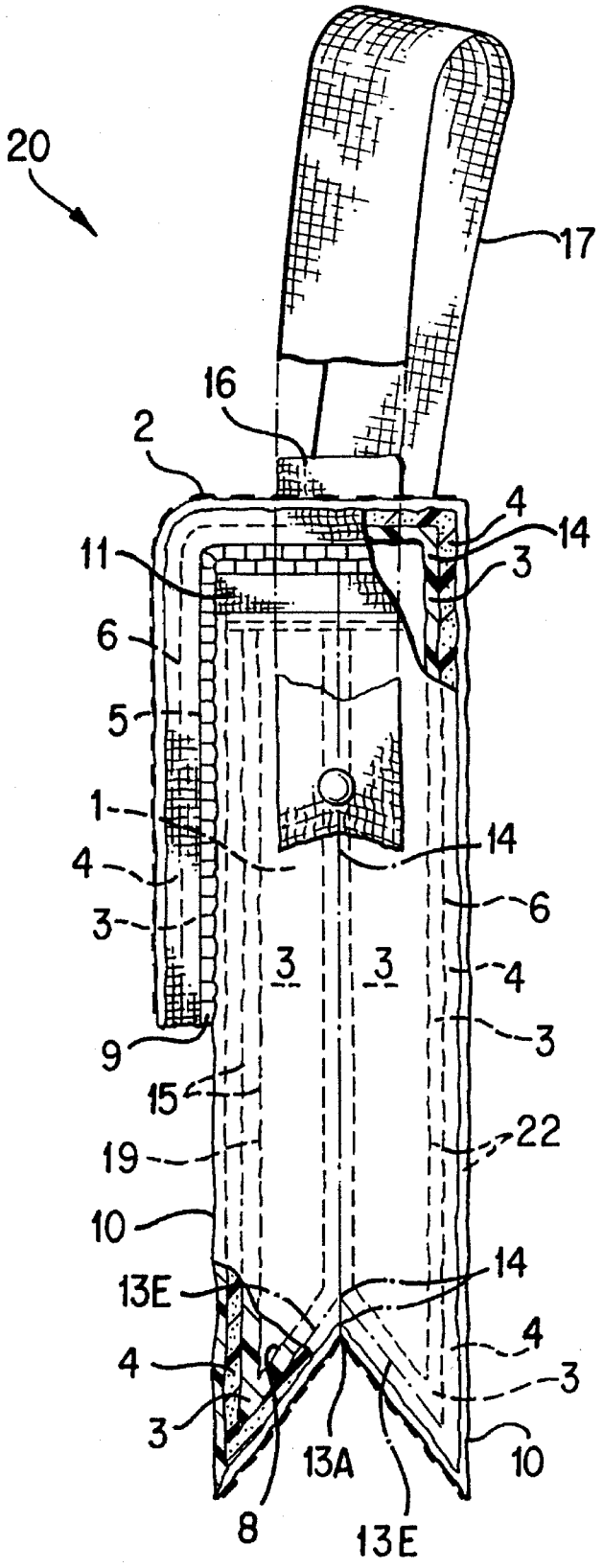
FIG. 3 is a side view in cross-section of the container in a completed fold or compressed position.

Shown in FIG. 3, however, not in FIG. 2 is the protruding or overlying position of the lid 2 as the content containment area 1 is fully folded. The lid folds over and can be compressed against the exterior of the front wall 10.

The flexible design of the container permitting the container to be flattened, therefore easily placed into a freezer, has the advantage of saving both space and time due to the fact container does not need to be assembled or dis-assembled. After freezing, the container is simply flexed in one movement back into the fully open position so that food and beverages can be placed into it, then, finally sealing lid to container.

Figure 4:
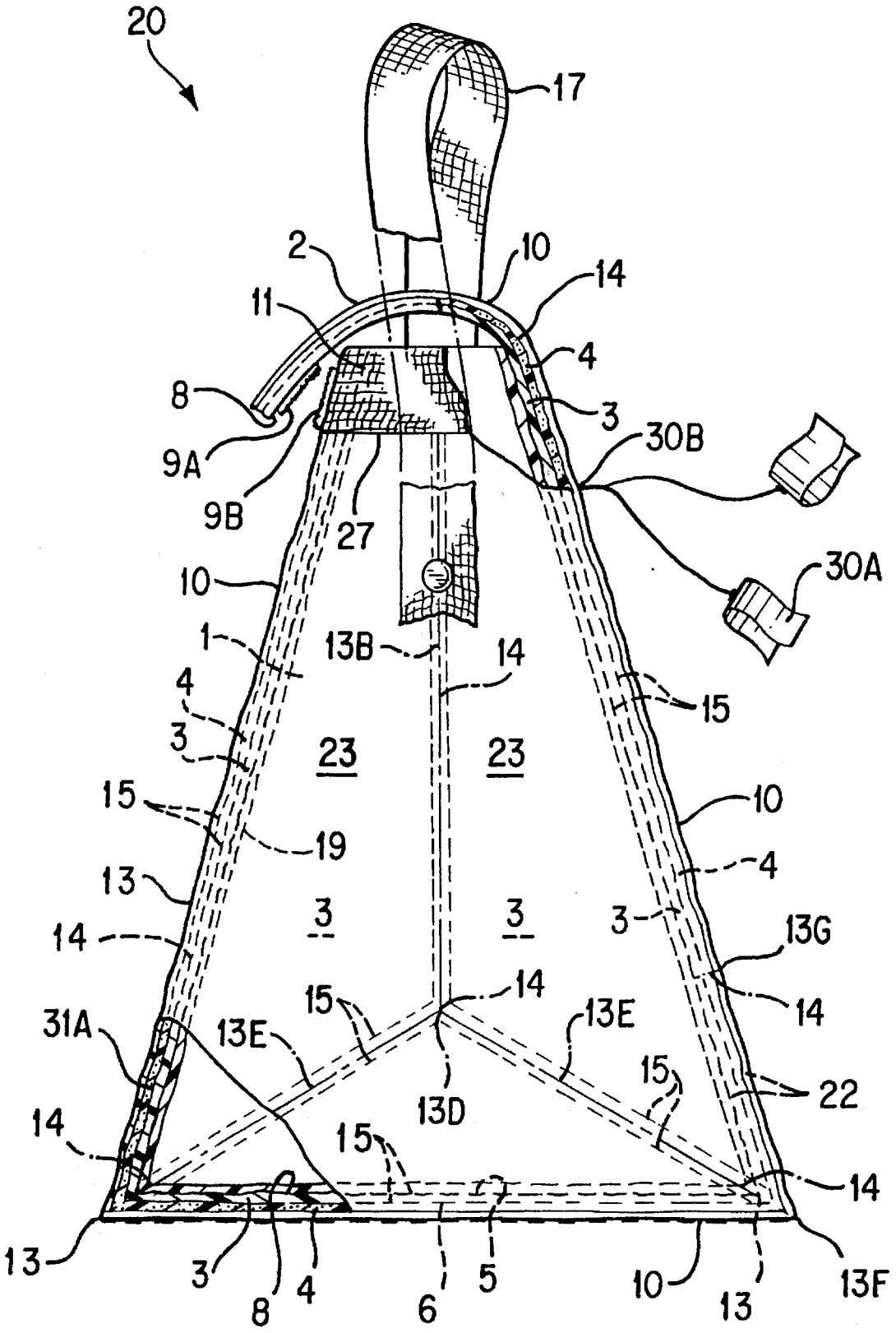
FIG. 4 is a side view in cross-section of the container in a rectangular/triangular foldable bag-like embodiment.

FIG. 4 is a side cross-sectional view showing the container in a rectangular/triangular bag-shaped embodiment. The front and back walls are rectangular 10, the base or floor 10 is square or rectangular depending on the width of the container and both sides 23 are triangular when the lid 2 is closed and the container is in the non-compressed position. The container design is much like the design of a standard brown paper shopping bag one has their food placed into at the supermarket. The purpose of this design as well as most of the features such as gel packs 3, foam insulation 4, attachable vinyl liner 19, condensation shields 5,6, walls, floor, interior skin 8, exterior skin 10 and double hollow walls with chamber 22 in between containing the refrigerated gel is basically the same as the container embodiment described in FIG. 1. The main difference is in the design of the container itself and the design in which it folds into described in FIG. 6 and 7. The lid attachment device is a velcro type velcro 9A and 9B. The portion of this hook and eye type connector means is attached along the interior skin 8 of the lid horizontally near the lid's terminal end. The velcro type fastener is attached from side end to side end on the lid interior skin. The lid attaches to the portion that runs correspondingly near the top front of the outer skin 10. The lid can maintain a tighter seal to the upper end of the container with the application of two clips 30A, one on each side that will pinch the lid to the container to help in maintaining it's contents in a cool condition. The clips as shown in FIG. 4 are attached to the container with a string 30B.

FIG. 4 shows a vertical crease in the middle of the side walls 13B which starts at the top of the side walls 23 and runs approximately four fifths of the way down the side walls where it meets the pinnacle of the triangular crease 13D. The creases are parallel to by the inter-connecting foldable plastic strips 14. As the front and back of exterior skins are compressed together, the vertical crease line 13B along with the triangular crease 13D parallel to by their conforming gel packs with corresponding inter-connecting plastic strips are folded inwardly toward the content containment area 1. This permits the container to fold into a relatively flat position until unfolded.

Figure 5:
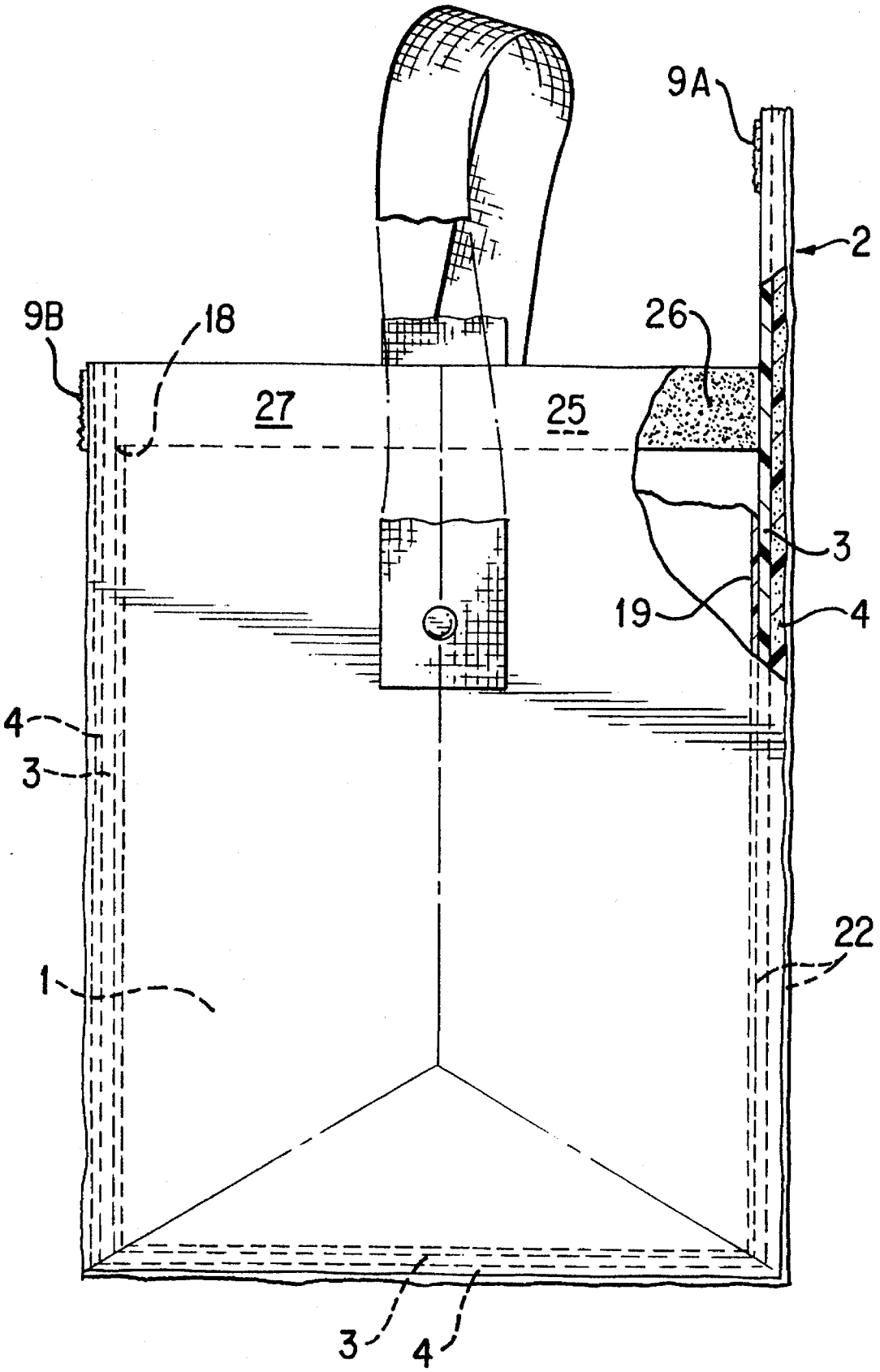
FIG. 5 is a side view of the bag shaped container in a fully open or unfolded embodiment.

FIG. 5 is a side view of the fully opened position of the rectangular/triangular container embodiment of FIG. 4. This would be the usual position of container when placing contents in or removing them from the container with the lid open and up 2. The entire content containment area 1 top to bottom, front to back and side to side would be open.

Figure 9:
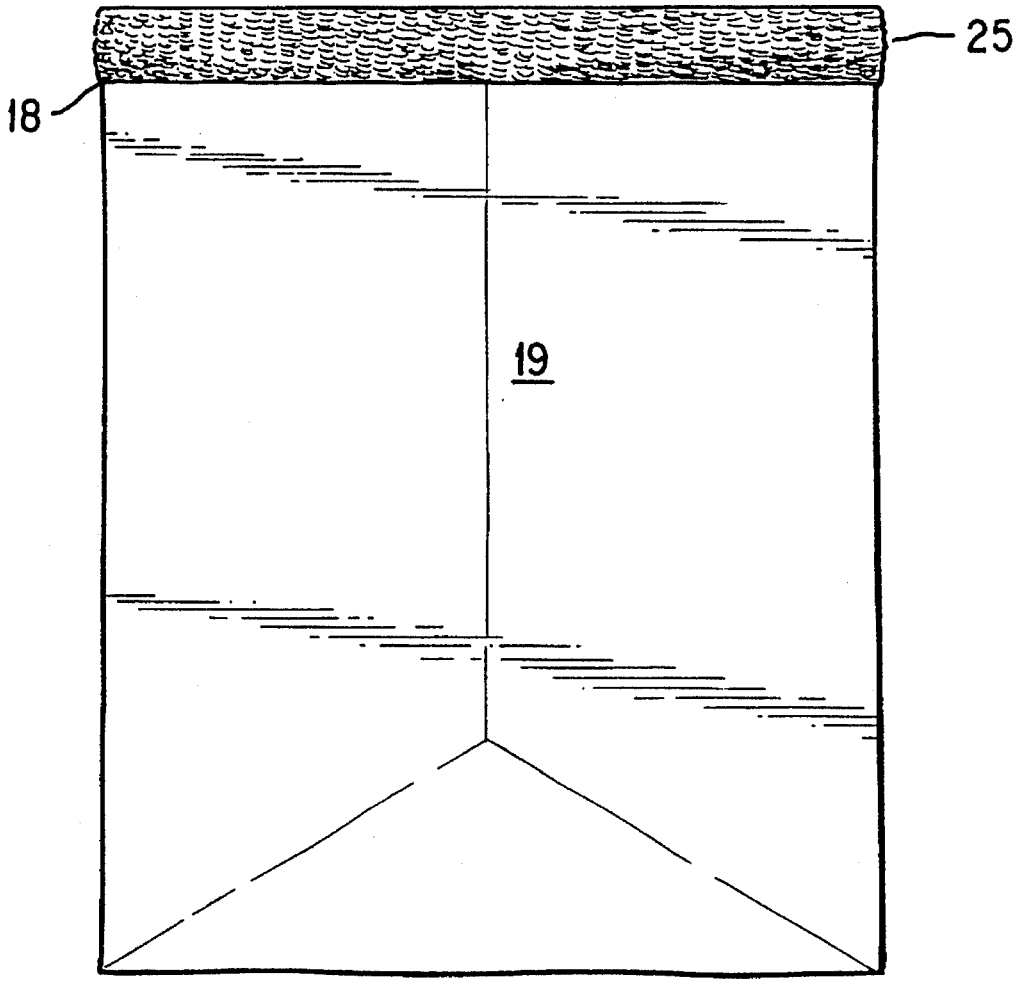
FIG. 9 is a side view of the liner with velcro strip.

A flexible and removable vinyl material 19 FIG. 5 and 9 which would conform to and parallel the entire area of the content containment area 1 interior walls and floor is optionally utilized. Liner with means 25 around liner's own upper exterior perimeter 18 would attach to the upper perimeter of the container's interior skin 27 which also has affixed the matching strip 26. This permits the liner to be attached and detached. The purpose of a removable liner would be for easy cleaning. The liner will fold when the container folds and may also be placed in the freezer with container.

Figure 6:
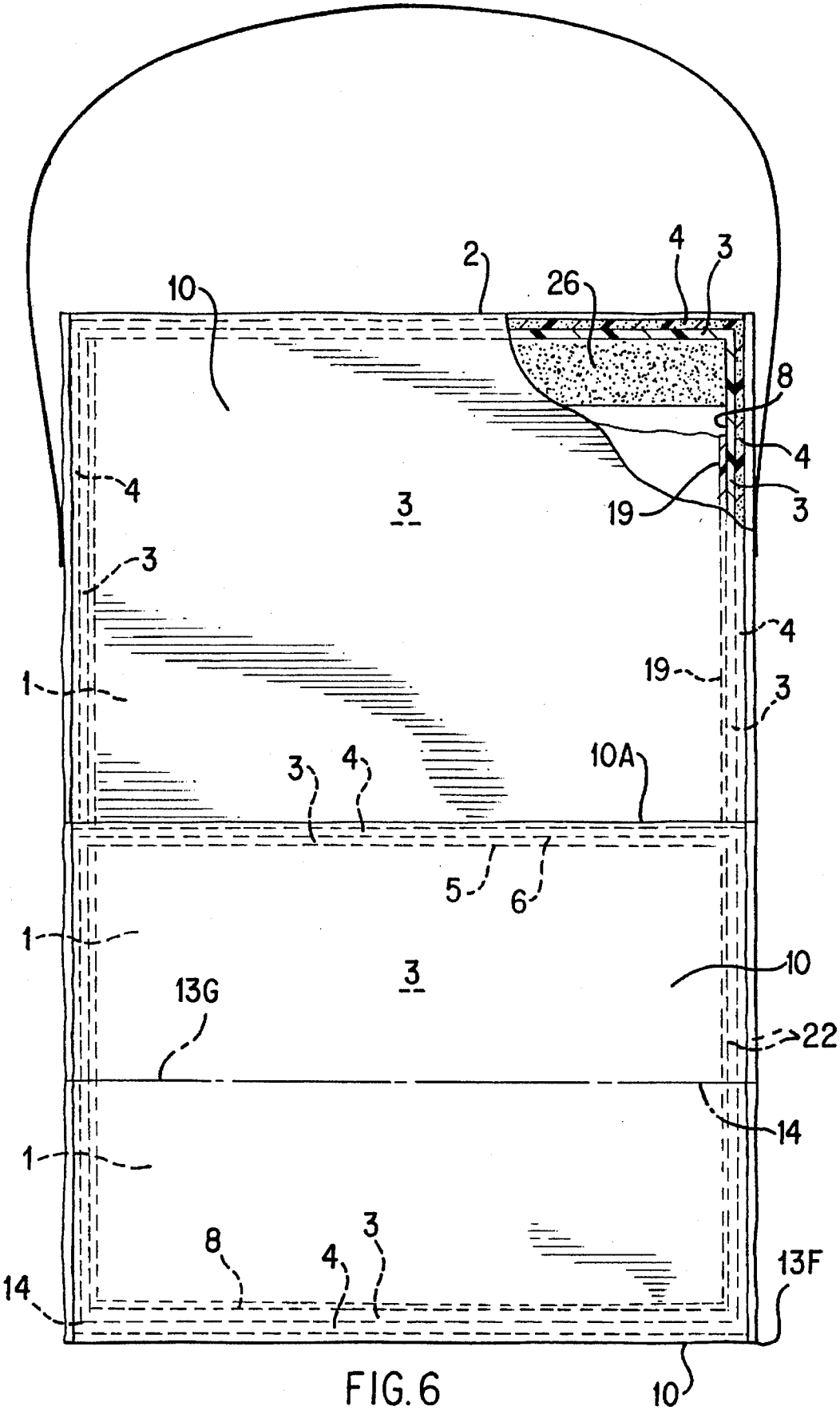
FIG. 6 is a back view of the bag shaped container in the folded or compressed position.

FIG. 6 is a view to the back exterior of container. This view shows the container in the upright folded and unfolded position with exterior floor 10 facing downwardly, then in the folded position shown by the dotted lines 3,4 and line 10A. In the standing position container base 10 as shown, has an outward crease line 13*f* at or near the back base edge that runs horizontally from side end to side end.

Figure 7:
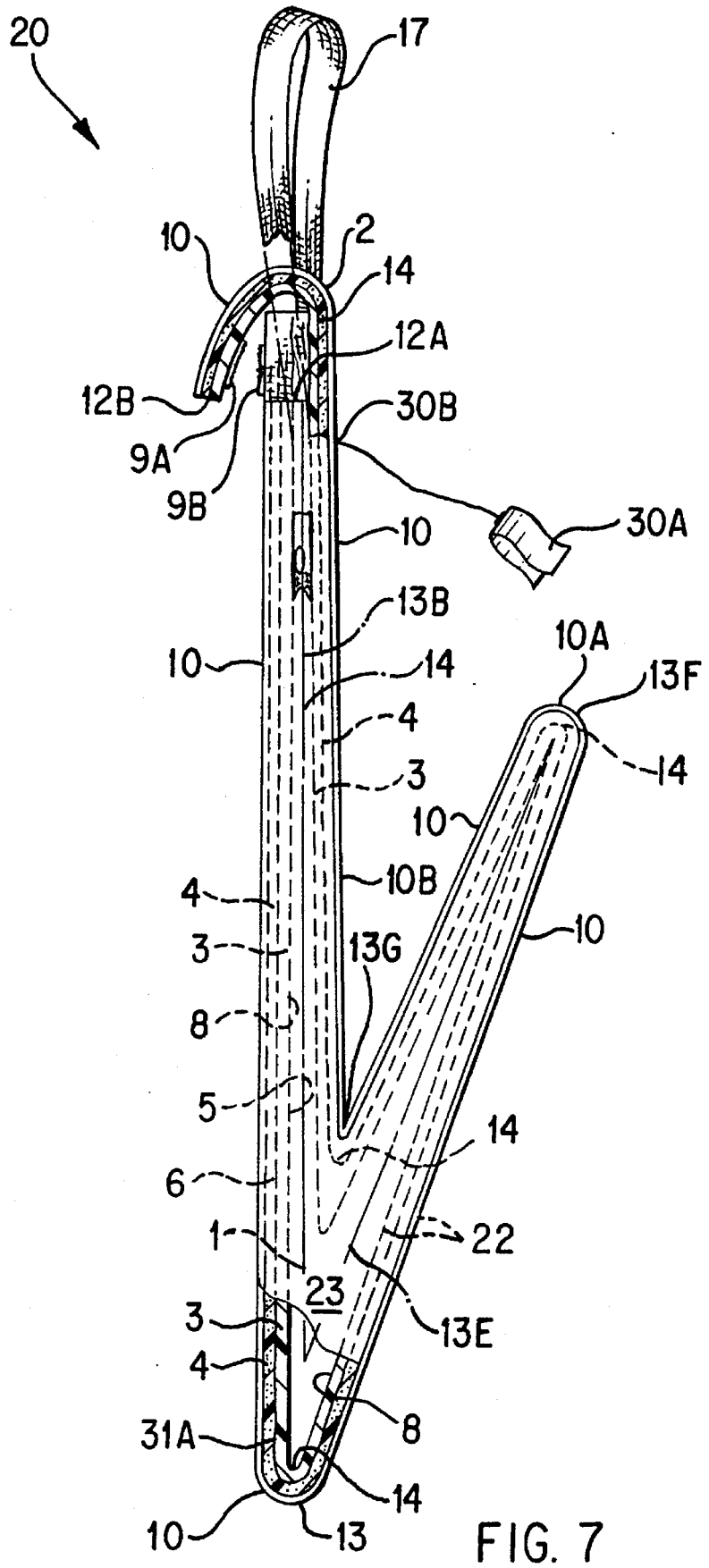
FIG. 7 is a side view in cross-section of the bag shaped container embodiment in the fully folded or compressed position.

Inside the double hollow walls are plastic strips 14 which connect the gel packs together for easy folding or hinged movement. Base folds approximately one half the way up to the back outer skins 10 terminating at line 10A, that of course brings the foam 4, gel 3 dotted line and shields 5,6 with it. Entire exterior base when the container is in the fully folded position and about one third of the lower back exterior skin 10 lies up against the back exterior skin 10, terminating at the line 10A. In a fully folded upright position the front exterior base edge 10 is shown at the bottom, 10. FIG. 7 will assist in clarifying the description of FIG. 6.

FIG. 7 side cross-sectional view shows the container in a fully folded position. As described in FIG. 6 it is shown how the base 10 folds upward toward the exterior back outer skin 10B folding primarily at the horizontal crease 13G which is located approximately one third the way up the exterior back skin. The sides 23 are folded inward to the containment area 1 along the verticle 13B and triangular 13E crease lines along with the corresponding flexible plastic strips 14, gel packs 3, shields 5,6 and foam 4 into a relatively flat postion for easy freezer placement.

FIG. 8 gel packs are comprised of a non-porous plastic encasement 31A, with refrigerant gel sealed within 3, flexible interconnecting plastic strips 14 that enable gel packs to bend or fold as the container 20 is compressed.

FIG. 9 is a side view of a removable and re-attachable vinyl liner which may be inserted into the interior of the content containment area 1. The interior of the containment area 1 may optionally have a one piece flexibe vinyl liner material 19 that follows the designed area of the container interior walls and floor 8. The top exterior parimeter of vinyl liner 18 has attached a strip 25. Liner's strip is attached to a companionate strip 26 on the top parimeter of the container's interior walls 27 FIG. 1, FIG. 2, FIG. 4, FIG. 5 of the containment area 1. Liner 19 which may be placed into the containment area 1 and then contents placed within liner. After use, liner can be detached cleaned and re-attached for use. Liner folds as container is compressed into a relatively flat position thereby both liner and container can be placed together as one unit into the freezer.

Container's flexible skin, flexible gel packs, flexible foam and flexible condensation shields permit the container to accomplish three important functions. A. Container's foldable design permits container to be placed into a frequently crowded freezer to be frozen, thereby saving space. B. Container as a simple and singular unit which needs no assembly or dis-assembly and, saves time. C. Container provides the important function of keeping food, medicine and other perishables cool for extended periods of time outside of a refrigerator. This function provides important health benefits and saves money by preserving perishables.

While this invention has been shown and described in what is considered to be a practical and preferred embodiment, it is recognized that departures may be made within the spirit and scope of this invention which should, therefore, not be limited except as set forth in the following claims and within the doctrine of equivalents.

What is claimed is:

1. A container comprising a floor, walls and lid, said walls including a terminal end defining a mouth opening and said container including:

an outer skin material means comprising liquid resistant and non-porous flexible skin material defining the outer surfaces of a floor, walls and lid, an inner skin material means comprising liquid resistant and non-porous flexible skin material spaced from said outer skin material means defining chamber means between the outer and inner skin material means, an attached lid sized to span said container mouth opening including means to attached to said container for opening and closing said mouth opening, said lid comprising a peripheral zone with seal means comprising a downwardly facing surface including attaching means confronting and to be attached to the container walls to form a seal between said lid and said walls, a gel means in the chamber means between the skin material means, including within said lid, to be cooled to maintain the interior of the container in a cooled condition, said gel means in said chamber means conforming to said chamber means, whereby said container and said gel means will be flexible and will fold when said container is compressed, wherein, when said container is compressed, said flexible inner and outer material skin means of said walls, floor and lid of said container will fold into a relatively flat position.

2. The container of claim 1 wherein said gel means is a refrigerant which is comprised of a sealed non-porous flexible plastic encasement sized and configured for placement in and conforming to said chamber means of said walls, floor and lid, whereby said gel may be cooled when placed into the freezer for cooling the contents placed in said container.

3. The container of claim 1 wherein said gel means can conform to said chamber means, to permit said container to fold into a relatively flat position for freezer placement and storage.

4. The container of claim 1 wherein said gel means comprises a plurality of gel packs and flexible non-porous plastic strips inter-connecting said plurality and comprising hinge means for swinging movement of said packs of said plurality relative to one another whereby said container may be folded into a relatively flat position for freezer placement or storage with said plurality within said chamber means.

5. The container of claim 1 including a liner composed of walls and floor, said liner composed of a flexible non-porous material means, said liner comprising an attachment means located approximately at the top exterior wall of said liner's entire perimeter said attachment means of said liner being connected to an identical attachment means located at an identical level positioned approximately at the top interior perimeter of said container's interior walls, said attached liner being approximately parallel to the entire area of said container's interior walls and floor, said liner's attachment means attaching to said containers interior walls matching said attachment means, whereby said liner can be detached, cleaned and re-attached.

6. The Container as set forth in claim 5 wherein said container attachment means comprises a Velcro-type material fixed to said liner's entire exterior upper perimeter thereby permitting said liner to be attached to matching type material positioned in said container's opposed top interior wall perimeter, wherein said liner means is attachable to and detachable from content containment area interior walls, contents can be placed into said liner, when removed from said liner, said liner can be detached, cleaned and re-attached, said liner is foldable within said content containment area of said container when said container is folded for placement into freezer or storage.

7. The container of claim 1 wherein said lid sealing means of the container top perimeter of walls, said sealing means comprising zipper means.

8. The container of claim 1 wherein said lid sealing means of said container top perimeter of walls comprises velcro type sealing means.

9. The container of claim 1 wherein said lid sealing means of said container top perimeter of wall comprises hook and loop type fastener means.

10. The container of claim 1 wherein said container comprises interior and exterior flexible skin means, said flexible skin means comprising a plastic material.

11. The container of claim 1 wherein said container with flexible interior and exterior walls, floor and lid, said walls, floor and lid with said gel packs contained in said chamber, said plurality of gel packs themselves being flexible with said inter-connecting flexible plastic strips connecting gel packs in chambers, in order to conform to said folding of walls, floor and lid, flexible insulating foam in said chamber, flexible condensation shields in said chamber, said flexible attachable liner in said content containment area, thereby permitting said container to be easily folded into a relatively flat position for freezer placement and said container to be easily unfolded after freezing for use, both said folding and unfolding of container requiring no assembly or dis-assembly as one singular container unit, thereby saving time and freezer space.

* * * * *